US006711265B1

(12) United States Patent
Morris, Jr.

(10) Patent No.: US 6,711,265 B1
(45) Date of Patent: Mar. 23, 2004

(54) CENTRALIZING OF A SPATIALLY EXPANDED STEREOPHONIC AUDIO IMAGE

(75) Inventor: Robert Edward Morris, Jr., Indianapolis, IN (US)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 10/009,141

(22) PCT Filed: May 12, 2000

(86) PCT No.: PCT/US00/13049

§ 371 (c)(1),
(2), (4) Date: Oct. 24, 2001

(87) PCT Pub. No.: WO00/70913

PCT Pub. Date: Nov. 23, 2000

Related U.S. Application Data

(60) Provisional application No. 60/134,005, filed on May 13, 1999.

(51) Int. Cl.[7] ..... H04R 5/00

(52) U.S. Cl. ..... 381/17; 381/98; 381/27

(58) Field of Search ..... 381/17, 103, 98, 381/99, 27

(56) References Cited

U.S. PATENT DOCUMENTS 4,229,716 A 10/1980 Levi
4,329,544 A 5/1982 Yamada
4,393,270 A 7/1983 van den Berg
4,451,927 A 5/1984 Hershberger
4,622,691 A 11/1986 Tokumo et al.
4,648,117 A 3/1987 Kunugi et al.
4,748,669 A 5/1988 Klayman
4,866,774 A 9/1989 Klayman
4,888,809 A 12/1989 Knibbeler
5,033,092 A 7/1991 Sadaie
5,146,507 A 9/1992 Satoh et al.
5,228,085 A 7/1993 Aylward
5,325,435 A 6/1994 Date et al.
5,371,779 A 12/1994 Kobayashi
5,467,400 A 11/1995 Keir
5,661,808 A 8/1997 Klayman
5,850,453 A 12/1998 Klayman et al.
5,892,830 A 4/1999 Klayman
5,970,152 A 10/1999 Klayman
6,038,323 A 3/2000 Petroff

*Primary Examiner*—Minsun Oh Harvey
(74) *Attorney, Agent, or Firm*—Joseph S. Tripoli; Joseph J. Laks; Reitseng Lin

(57) ABSTRACT

In a stereophonic system having sum and difference signals with expanded spatial imaging, localization of center audio materials more towards the center is accomplished by equalization of the (L+R) sum signal. The equalization comprises decreasing the bass response while increasing the treble response of the sum signal with the desired bass reduction being accomplished by the use of a gyrator to economically synthesize an inductance. Additionally, the equalizations in the (L+R) sum signal to reduce the signal at bass frequencies and to increase the signal at treble frequencies are switchable singly or in combination between "ON" and "OFF" modes.

18 Claims, 3 Drawing Sheets

CENTRALIZING OF A SPATIALLY EXPANDED STEREOPHONIC AUDIO IMAGE

This application claims the benefit of U.S. provisional application Serial No. 60/134,005 filed May 13, 1999, which is hereby incorporated herein by reference, and which claims the benefit under 35 U.S.C. §365 of International Application PCT/US00/13049, filed May 12, 2000, which was published in accordance with PCT Article 21(2) on Nov. 23, 2000 in English.

BACKGROUND

Stereophonic enhancement audio systems typically process sum (L+R) and difference (L−R) signal components which, if not otherwise available, can be genrerated from a pair of left (L) and right (R) signals. The difference signal can be used to create a spatially broadened stereo image when reproduced through a pair of left and right loudspeakers or through a surround system.

Boosting the level of the difference signal with respect to the sum signal can widen such a perceived sound image. Such processing of the difference signal includes equalization comprising both bass and treble boost. However, an increase in level in the difference signal can have undesirable effects on a person's perception of the sound. For example, boosting of the difference signal in the mid-range of audio frequencies can cause a sound perception which is undesirably very sensitive to the physical location of the listener with respect to the left and right loudspeakers. Further, the spatially broadened stereo image does not properly localize sounds which would normally emanate from the center, such as speech from a person visually centered on a display of television or motion picture programming. This is the case whether or not the sound system includes a center loudspeaker or just left and right loudspeakers.

It has been found that in a system having an increase in the level of the (L−R) difference signal with respect to the (L+R) sum signal to produce a spatially broadened stereo image, that decreasing the bass response of the (L+R) sum signal along with increasing the treble response of the (L+R) sum signal helps the listener to better localize central audio material more towards the center.

SUMMARY OF THE INVENTION

For a consumer product it is necessary to keep costs low. It is herein recognized that the desired bass reduction in the (L+R) sum signal of the audio system, to help the listener to localize center audio material more towards the center, can be accomplished by the use of a gyrator to economically synthesize an inductance. A gyrator generated inductance, in combination with a resistance in the (L+R) sum signal path, economically provides such a decreasing bass frequency response while avoiding the deficiencies of a wound inductance which would be more expensive, bulky, and subject to the picking-up of hum and other electromagnetic/electrostatic extraneous noise and signals. Thus, the gyrator synthesized inductance, as well as being more economical, can be used in a lower signal level portion of the audio system.

Additionally, the equalization(s) of the (L+R) sum signal to reduce the signal at bass frequencies and to increase the signal at treble frequencies are switchable singly or in combination between "ON" and "OFF" modes, and/or are adjustable singly or in combination. This switchability/adjustability permits greater flexibility to tailor the response of the system to the listener's satisfaction.

DESCRIPTION OF THE PREFERRED EMBODIMENT

Figure 1:
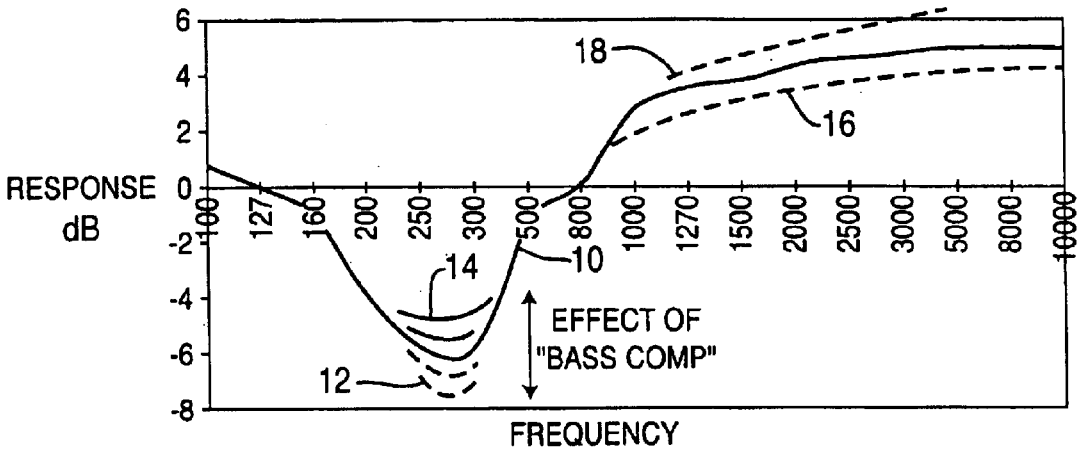
FIG. 1 is a graph of the desired frequency response of the (L+R) sum signal for providing the desired centralizing locationalization effect for center audio material.

Referring to the drawings wherein like members are given like numeral designations, FIG. 1 shows a nominal graph of the desired frequency response 10 of the (L+R) sum signal for providing the desired centralizing locationalization effect for center audio material. This frequency response shows various levels of decreased bass response between the dashed lines of minimum bass 12 and maximum base 14 starting at 580 Hz, with a minimum response between 250 and 300 Hz, and then with an increasing bass response for a one dB gain at 100 Hz. The nominal treble response increases starting at 580 Hz up to a maximum gain of about 4 dB at about 2,000 Hz and above, within minimum treble 16 and maximum treble 18 limits shown by dashed lines.

Figure 2:
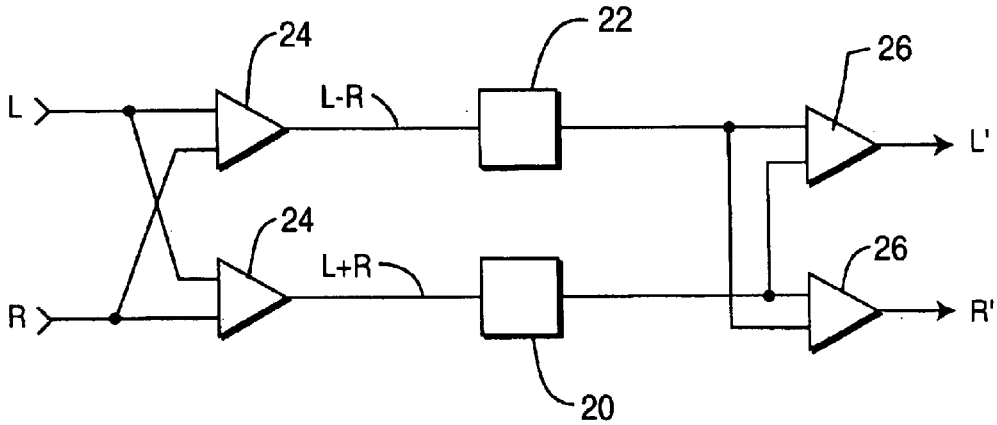
FIG. 2 shows block diagrams of the equalization in the (L+R) sum signal path and the spatial image broadening equalization in the (L−R) difference signal path.

FIG. 2 shows in block diagram form, the present equalization 20 in the (L+R)sum signal path and the spatial image broadening equalization 22 in the (L−R) difference signal path. Spatial image broadening equalization 22 using the (L−R) difference signal is known in the prior art.

FIG. 2 shows the formation of the (L+R) and (L−R) signals from L and R signals, but this need not be the case for an FM or television stereophonic program in the United States wherein the detected signals are already in (L+R) and (L−R) format, and have to be matrix decoded to provide separate L and R signals. Thus, matrixing encoders/decoders 24/26 are shown for the instance when the difference (L−R) and sum (L+R) signals have to be both encoded and decoded.

Figure 3:
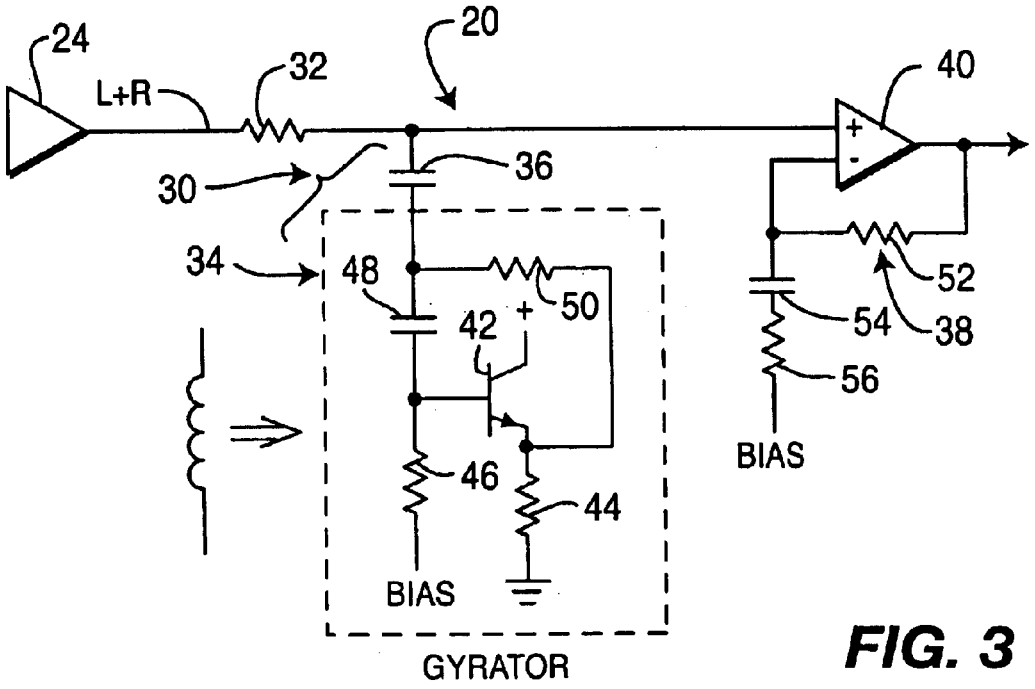
FIG. 3 shows a schematic diagram of the block of FIG. 2 which provides the equalization in the (L+R) sum signal path.

FIG. 3 shows schematic diagrams of the block 20 of FIG. 2 which provides the equalization in the (L+R) sum signal path which helps the listener to localize center audio material more towards the center LC network 30 is a divider with resistor 32 effectively realizing the bass frequency response of FIG. 1. Simulated gyrator inductance 34 has reduced impedance at lower frequencies, thus reducing the bass response with divider resistor 32 until the impedance of capacitor 36 in series with inductance 34 takes over and raises the response at lower frequencies. This divider can be placed at the input of an op-amp stage 38 which buffers the signal and allows a simple series RC network using feedback around op-amp 40 to provide the high frequency boost shown in FIG. 1.

More particularly, the gyrator 34 comprises a general purpose transistor 42 having an emitter electrode coupled to ground through resistor 44, and a base electrode biased through resistor 46. Capacitor 48 coupled to the base electrode, in combination with feedback resistor 50 in an almost unity gain emitter follower amplifier configuration, provide the gyrator simulated effective inductance of about 1.5 Henries. There are other circuit configurations for providing a gyrator circuit, many of which can be used herein. The gyrator 34 configuration shown is merely exemplary and is chosen to provide the required operation with a minimum cost of parts.

Capacitor 36 couples gyrator 34 to resistor 32 and provides the increasing impedance at low bass frequencies in order to increase the gain at lower bass frequencies, as discussed above, with a one dB gain at 100 Hz. The bias, provided through resistor 46, places transistor 42 in a linear operating region.

High pass filter 38 comprises op-amp 40 with feedback resistor 52 coupled to the negative terminal and a series RC network of capacitor and resistor 54, 56 coupled from the negative terminal to a source of bias which also provides an AC ground. For rising frequencies, the impedance of capacitor 54 goes down and the feedback is reduced, thus increasing the gain of op-amp 40. The bias is adjusted to place op-amp 40 in a linear operating region.

Figure 4:
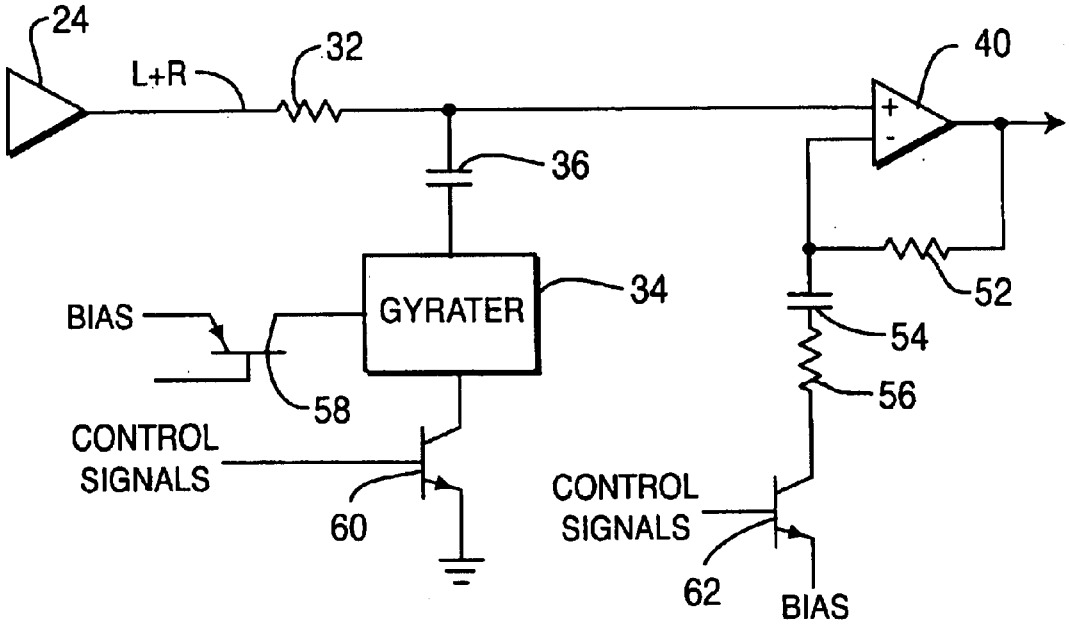
FIG. 4 shows switching of the bass and treble equalization circuits of FIG. 3.

FIG. 4 shows the switching of the bass and treble equalization(s) circuits of FIG. 3. The equalization portions can be switched into an "ON" or an "OFF" mode, singly or in combination. This permits greater flexibility to tailor the response of the system to the listener's satisfaction.

This switching can be provided in response to respective control signals provided by a microprocessor (not shown), with the switching being accomplished by commonly available devices, e.g., a relay, a bipolar transistor, a MOS/CMOS FET or the like, which can be discrete components or be provided in a monolithic integrated circuit, as appropriate. The control signals are applied to respective transistors to saturate or to cut-off transistors 60, 62 of the respective gyrator and treble boost circuits. Additionally, the control signals applied to transistors 60, 62, and the bias provided by transistor 58, can each be variably adjustable, and for transistors 60, 62 be adjustable within the limits of the control signals necessary to switch the transistors between "ON" and "OFF".

Figure 5:
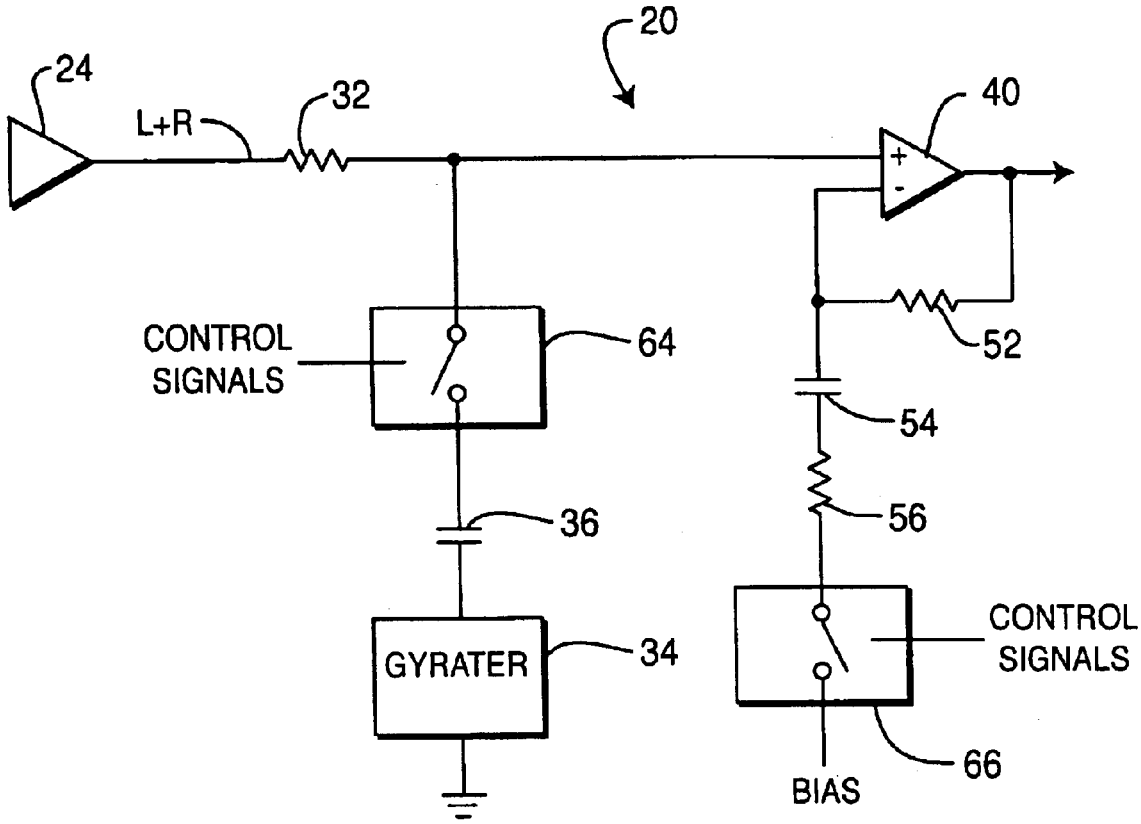
FIG. 5 shows an alternate embodiment of the switching of FIG. 4.

FIG. 5 shows an alternate embodiment of the switching arrangement of FIG. 4 wherein the switch for the gyrator 34 and LC network 30 is removed from ground and is shown as a generic switch 64 responsive to a respective control signal, and the high pass filter circuit 38 is shown as being switched by a generic switch 66 responsive to its respective control signal.

The exemplary values of elements shown in the various Figs. are: resistor 32=3.3 Kohms, capacitor 36=0.22 uf, resistor 46=68 Kohms, resistor 44=1 Kohm, resistor 50=2.2 Kohms, resistors 52/56=15 Kohms and capacitor 54=0.01 uf. The transistors 42, 58, 60, and 62 can be non-critical signal types, e.g., 2N2222, and op-amp 40 is a non-critical general purpose MC3404 op-amp.

What is claimed is:

1. A stereophonic audio system, comprising:

means for providing (L+R) and (L−R) signals and respective signal paths;

means for providing a spatially expanded stereophonic audio effect in the (L−R) signal, and means for processing the (L+R) signal for concentrating the apparent location of central sounds closer to the center between left and right sound emanating loudspeakers, the means for processing comprising:

means for reducing signal levels at bass frequencies, and means for increasing signal levels at treble frequencies, the means for reducing signal levels at bass frequencies comprising a gyrator.

2. The audio system of claim 1 wherein the gyrator is in shunt across the (L+R) signal path.

3. The audio system of claim 1 wherein the means for increasing signal levels at treble frequencies comprises a high pass filter in series with the (L+R) signal path.

4. The audio system of claim 1 wherein the bass signal reduction includes frequencies within the band of 100 Hz to 580 Hz.

5. The audio system of claim 1 wherein the treble signal increase includes frequencies above 580 Hz.

6. The audio system of claim 1 wherein the reduction of signal levels at bass frequencies and the increase of signal levels at treble frequencies are switchable singly or in combination between "ON" and "OFF" modes.

7. The audio system of claim 6 wherein the switching is responsive to control signals.

8. The audio system of claim 7 wherein the control signals are provided by a microprocessor.

9. A stereophonic audio system, comprising:

means for providing (L+R) and (L−R) signals and respective signal paths;

means for providing a spatially expanded stereophonic audio effect in the (L−R) signal, and means for processing the (L+R) signal for concentrating the apparent location of central sounds closer to the center between left and right sound emanating loudspeakers, the means for processing comprising:

means for reducing signal levels at bass frequencies, and means for increasing signal levels at treble frequencies, the means for reducing signal levels at bass frequencies and the means for increasing signal levels at treble frequencies being switchable singly or in combination between "ON" and "OFF" modes.

10. The audio system of claim 9 wherein the switching is responsive to control signals.

11. The audio system of claim 10 wherein the control signals are provided by a microprocessor.

12. A stereophonic audio system, comprising:

means for providing (L+R) and (L−R) signals and respective signal paths;

means for providing a spatially expanded stereophonic audio effect in the (L−R) signal, and means for processing the (L+R) signal for concentrating the apparent location of central sounds closer to the center between left and right sound emanating loudspeakers, the means for processing comprising:

means for reducing signal levels at bass frequencies, and means for increasing signal levels at treble frequencies, the means for reducing signal levels at bass frequencies comprising a gyrator, the reduction signal levels at bass frequencies and the increase signal levels at treble frequencies are switchable singly or in combination between "ON" and "OFF" modes.

13. The audio system of claim 12 wherein the gyrator is in shunt across the (L+R) signal path.

14. The audio system of claim 12 wherein the means for increasing signal levels at treble frequencies comprises a high pass filter in series with the (L+R) signal path.

15. The bass signal reduction includes frequencies within the band of 100 Hz to 580 Hz.

16. The audio system of claim 12 wherein the treble signal increase includes frequencies above 580 Hz.

17. The audio system of claim 12 wherein the switching is responsive to control signals.

18. The audio system of claim 17 wherein the control signals are provided by a microprocessor.

* * * * *